US006547084B2

(12) United States Patent
Bauman et al.

(10) Patent No.: US 6,547,084 B2
(45) Date of Patent: Apr. 15, 2003

(54) REPLENISHABLE MERCHANDISING DISPLAY FOR USE IN A RETAIL ENVIRONMENT

(75) Inventors: Cindy A. Bauman, Hilton, NY (US); Edward Zogg, Ontario, NY (US); Gaylynn F. Durkin, Rochester, NY (US); Gary W. Schum, Alexander, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/940,205

(22) Filed: Aug. 27, 2001

(65) Prior Publication Data

US 2003/0038099 A1 Feb. 27, 2003

(51) Int. Cl.[7] ..... A47F 5/00

(52) U.S. Cl. ..... 211/71.01; 211/85.17; 280/79.3; 312/138.1

(58) Field of Search ..... 211/71.01, 134, 211/85.17, 49.1; 280/79.3; 312/117, 138.1, 249.8

(56) References Cited

U.S. PATENT DOCUMENTS 746,758 A * 12/1903 Stiggleman
905,809 A * 12/1908 Garman
1,617,799 A * 2/1927 Emanuel et al.
1,863,493 A 6/1932 Lines
1,929,615 A 10/1933 Tanner
2,608,340 A 8/1952 Donnell
2,810,474 A 10/1957 Essick
3,010,290 A * 11/1961 Fredrick
3,308,934 A 3/1967 Reiner
4,825,624 A 5/1989 Calcerano
4,982,839 A * 1/1991 Stevens
5,158,175 A 10/1992 Crawford
5,167,324 A 12/1992 Miller
5,251,753 A 10/1993 Pigott et al.
5,293,991 A 3/1994 Neumann et al.
5,341,944 A * 8/1994 Latino ..... 211/94.01
5,630,518 A * 5/1997 Collins ..... 211/132.1
5,706,953 A 1/1998 Polvere
5,762,203 A 6/1998 Klawiter et al.
5,839,587 A * 11/1998 Gress et al. ..... 211/49.1 X
5,850,922 A 12/1998 Fraser
6,126,022 A * 10/2000 Merkel
6,428,123 B1 * 8/2002 Lucht et al. ..... 312/138.1

* cited by examiner

*Primary Examiner*—Robert W. Gibson, Jr.
(74) *Attorney, Agent, or Firm*—Clyde E. Bailey, Sr.

(57) ABSTRACT

A replenishable merchandising display requires the product to be displayed for sale be loaded into modular receptacles at the manufacturer and that a merchandising display for receiving the modular receptacles be shipped to a retailer. The retailer then loads the modular receptacles containing product into the merchandising display and eventually replenishes the merchandising display once the product is depleted.

8 Claims, 5 Drawing Sheets

REPLENISHABLE MERCHANDISING DISPLAY FOR USE IN A RETAIL ENVIRONMENT

CROSS-REFERENCE TO RELATED APPLICATIONS

The present application is related to U.S. application Ser. No. 81464, filed herewith, by Bauman, et al., and entitled, "METHOD OF REPLENISHING PRODUCT FOR RETAIL IN A MERCHANDISING DISPLAY."

FIELD OF THE INVENTION

The invention relates generally to the field of merchandising displays for promotional articles or product. More particularly, the invention concerns a method of replenishing articles in a modular merchandising display and a modular merchandising display that can be easily replenished or refilled with product at the retailers thus eliminating the need for multiple packaging steps, cumbersome shipping and associated additional expense.

BACKGROUND OF THE INVENTION

A variety of promotional displays exist for merchandising product, e.g., photographic film rolls, in a retail environment. Most common is the use of temporary merchandising displays often made from corrugated paperboard material, which comes to the retailer pre-stocked with product. These temporary merchandising displays are generally conveniently positioned on the retail floor and product contained therein is directly withdrawn by the consumer until all is depleted. Once the temporary merchandising display is empty of product, it is typically discarded and replaced with a new pre-filled temporary display unit.

Typical examples of prior art temporary merchandising displays are disclosed in U.S. Pat. Nos. 5,251,753 by Pigott et al, titled "Combined Product Shipping And Display Unit," Oct. 12, 1993; U.S. Pat. No. 5,167,324 by Miller, titled "Shipping Carton And Display Unit For Tubes," Dec. 1, 1992; U.S. Pat. No. 3,308,934 by Reiner, titled "Display Package," Mar. 14, 1967; U.S. Pat. No. 4,825,624 by Clacerano, titled "Modular Promotional Display," May 2, 1989; U.S. Pat. No. 5,293,99 by Neuman et al., titled "Combined Shipping and Presentation Package," Mar. 15, 1994; U.S. Pat. No. 5,762,203 by Klawiter et al., titled "Container For Shipping And Displaying Of Product," Jun. 9, 1998; and U.S. Pat. No. 5,706,953 by Polvere, titled "Combination Shipping Carton and Display Stand Formed With Insert Panels And Shelves. Each of these displays is adaptable to be used as a shipping carton for shipping merchandise and a display for displaying the merchandise. In some of the displays, such as the ones described in U.S. Patents '991, '324, and '753, additional conversion elements or steps are required to convert the package into a suitable merchandising display.

It is well known in the packaging industry that temporary merchandising displays of the sort described above have generally complex designs and structures. Moreover, such merchandising displays are not usually assembled or filled automatically at the point of manufacture or packaging of the product.

The skilled artisan in the art of merchandising displays and product shipment is aware that it is a major shortcoming of the rather typical process that the pre-filled merchandising displays are generally bulky, heavy, costly, and difficult to stock and then ship.

Therefore, a need persists in the art for a modular merchandising display that is simple, convenient for the retailer to stock and display product, and cost effective to implement.

SUMMARY OF THE INVENTION

It is, therefore, an object of the invention to provide a replenishable merchandising display that can be efficiently replenished at the retail location.

Another object of the invention is to provide a replenishable merchandising display fabricated from structurally durable materials that enables considerably longer use.

To achieve these and other objects and advantages of the invention, a replenishable merchandising display comprises:

an upright standing, substantially rigid frame comprising a plurality of product compartments, each one of said plurality of product compartments having a top wall and an opposed bottom wall defining a base, and opposed side walls each being adjoined to a rear wall, and said opposed side walls exposing an opening to receive and access at least one generally polygonal-shaped modular receptacle; and said at least one generally polygonal-shaped modular receptacle being removably stored in one of said plurality of product compartments, said at least one generally polygonal-shaped modular receptacle accommodating a predetermined quantity of sales unit of a product.

The present invention has the following advantages over prior art developments: cost effectiveness; increased product replenishing efficiency; reduced inventory for the retailer; elimination of multiple packaging steps and associated waste of packaging materials; and, elimination of the shipment of filled merchandising displays and the associated risk of loss.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
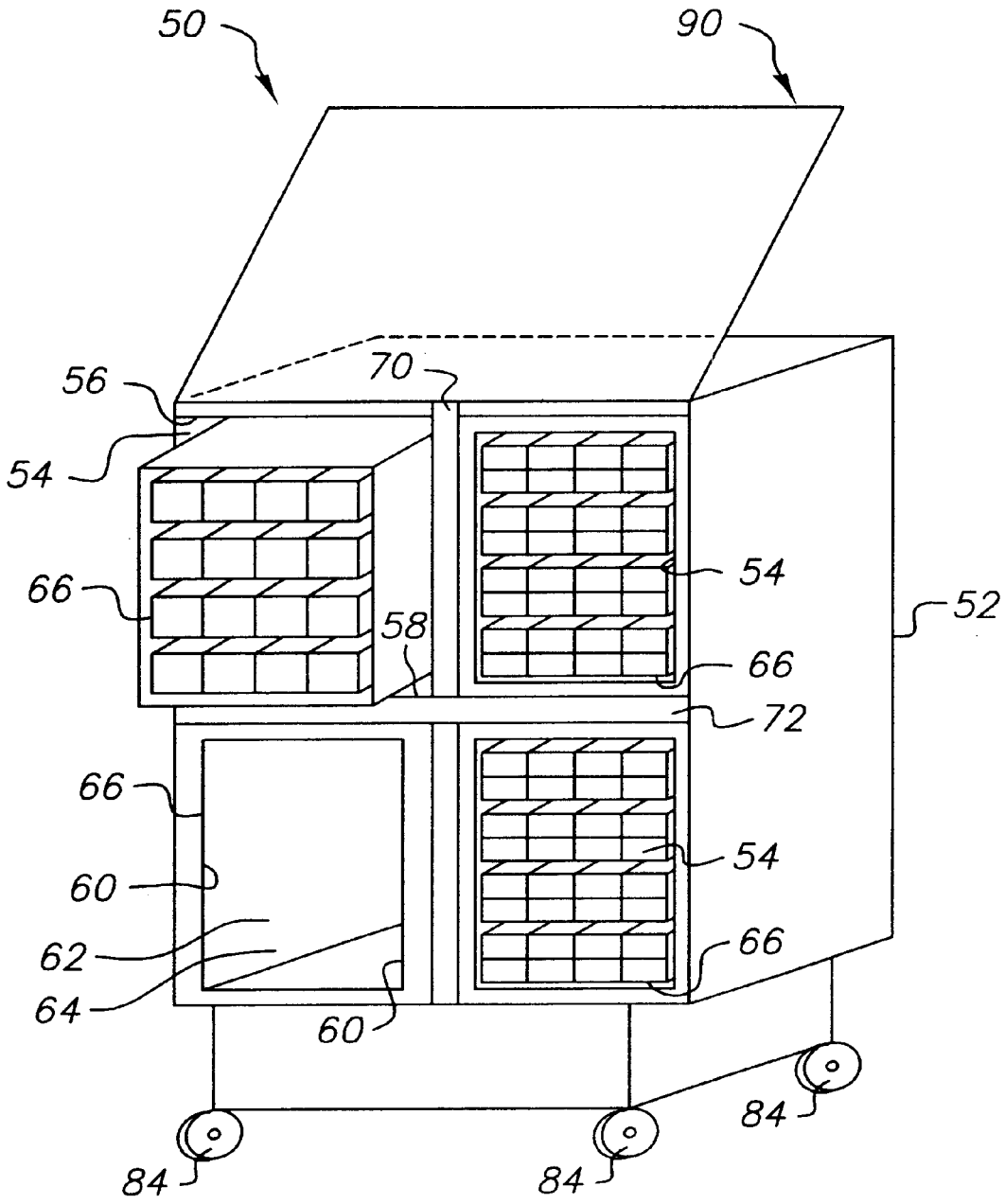
FIG. 1 is a perspective view of the merchandising display of the invention partially filled with modular receptacles.
Figure 2:
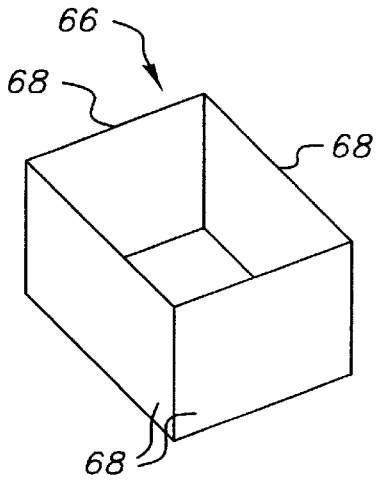
FIG. 2 is a perspective view of a modular receptacle that can be filled with merchandise at the point of manufacture.
Figure 3:
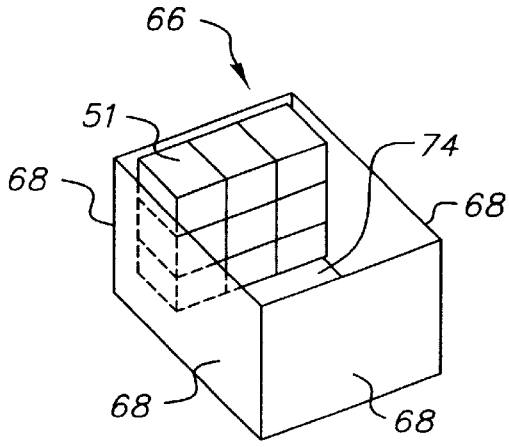
FIG. 3 is a perspective view of a modular receptacle partially filled with product.

Turning now to the drawings, and in particular to FIGS. 1–3, the replenishable merchandising display 50 of the invention is illustrated. As shown in FIG. 1, replenishable merchandising display 50 has an upright standing, substantially rigid frame 52. Frame 52 is constructed of a durable material, preferably a corrugated plastic material, such as corrugated polyethylene. Skilled artisans will appreciate that frame 52 may also be formed of other durable materials including metals, thermoformable polymeric materials, thermoset materials, and metallic materials. This feature enables the walls 56, 58, 60 (described below) to withstand fairly frequent product replacement procedures implemented primarily at the retailer.

Referring to FIG. 1, a plurality of product compartments 54 is formed in frame 52 for accommodating a predetermined quantity of sale units of a product 51 (shown in FIG. 3). Each product compartment 54 has a top wall 56 and an opposed bottom wall 58 defining a base. Opposed side walls 60 are adjoined to a rear wall 62 and expose an opening 64 to receive and access at least one modular receptacle 66 (also referred to as a product container), described in detail below, that contains the product 51 for sale.

Referring to FIGS. 2–3, modular receptacle 66 has a generally polygonal shape, an open face 74, and is removably stored in one of the plurality of product compartments 54 arranged in merchandising display 50. An important feature of modular receptacle 66 is its simplistic design and structure. For ease of filling at the product manufacturer's location, modular receptacle 66, commonly referred to as a half-slotted container, has minimum folds and no interlocking parts. Structurally, modular receptacle 66 may be made of practically any semi-rigid material, such as corrugated paperboard.

Figure 4:
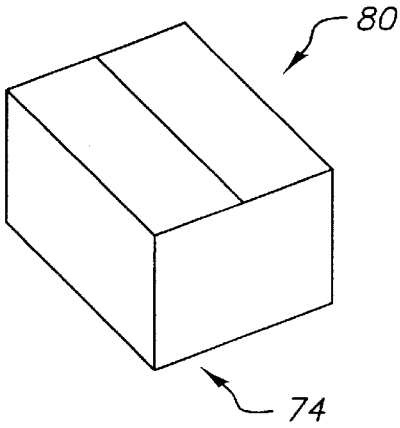
FIG. 4 is a perspective view of a top cover for shipment to a retailer.
Figure 5:
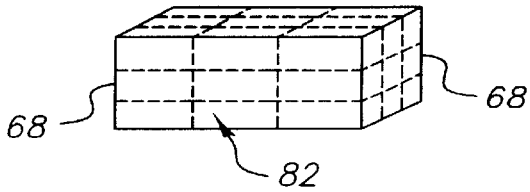
FIG. 5 is a perspective view of a shrink wrap for covering a modular receptacle for shipment to a retailer.

According to FIGS. 4–5, the product manufacturer may, in a variety of ways, protect the product 51 contained in the modular receptacle 66 from shipping damage and pilferage. An open face container 80 similar to modular receptacle 66 may be used to cover the open face 74 of the modular receptacle 66. Preferably, open-faced container 80 has a substantially identical shape and dimension to that of modular receptacle 66 and is fabricated from similar materials. According to FIG. 5, another way to protect product 51 in modular receptacle 66 is to apply a shrink wrap material 82, such as polyethylene, about the open face 74 and side walls 68 of modular receptacle 66. Such a wrap material will more than adequately secure the product 51 in the modular receptacle 66. Skilled artisans will appreciate that there are numerous other ways to protect the product 51 during shipment that are within the contemplation of the invention.

Figure 6:
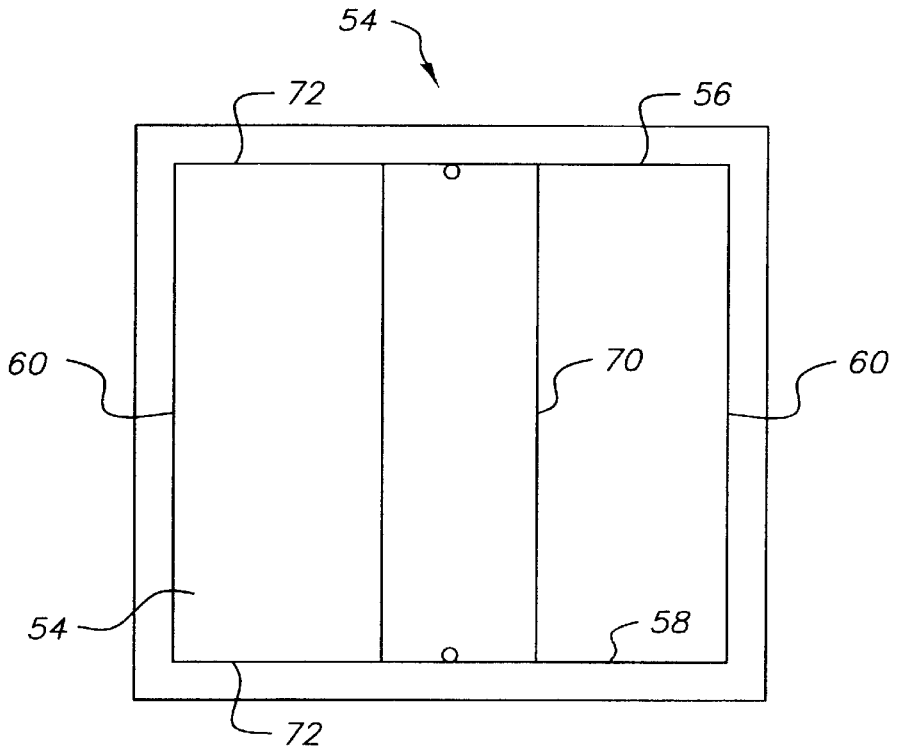
FIG. 6 is a cross-section view of a product compartment showing the vertical stabilizer member in a first position.
Figure 7:
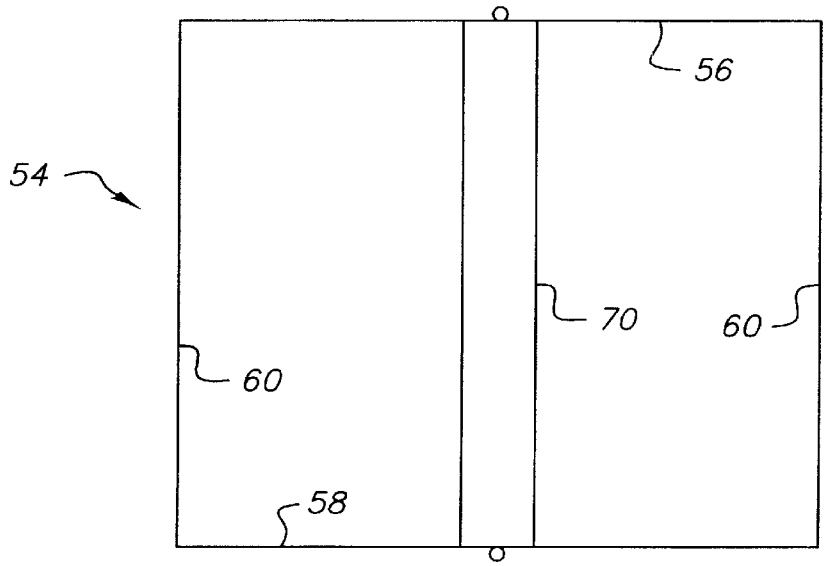
FIG. 7 is a cross-section view of a product compartment showing the vertical stabilizer in a second position.

Referring to FIGS. 6–7, a vertical stabilizer member 70 having a substantially rectangular shape is rotatably associated with the base in frame 52 for accommodating a modular receptacle 66 of a predetermined dimension. More particularly, vertical stabilizer 70 is affixed in frame 52 for pivotable movements between the top wall 56 and bottom wall 58 of the product compartment 54. According to FIGS. 6 and 7, vertical stabilizer member 70 is made to pivot in product compartment 54 between top wall 56 and bottom wall 58 to accommodate modular receptacles 66 having various dimensions. It is also important that a vertical stabilizer member 70 is present between the horizontal members 72 of the product compartments 54 to help support the weight of the product 51 in the product compartments 54 in the upper part of the merchandising display unit. In FIG. 6, the vertical stabilizer member 70 is in a first position for accommodating a modular receptacle 66 that has an open face dimension that is relatively narrow. According to FIG. 7, vertical stabilizer member 70 is pivoted to a second position to accommodate a modular receptacle 66 that is relatively wide. Skilled artisans will appreciate that vertical stabilizer member 70 supports the weight of the product 51 in the product compartments 54 in the upper part of the merchandising display 52.

Referring again to FIG. 1, merchandising display 50 may optionally be freestanding or mobile. In the latter embodiment, a plurality of roller members 84, such as casters, may be rotatably attached to rigid frame 52. Those skilled in the art will appreciate that other means of mobilizing merchandizing display 50 may be used with substantially identical results.

Figure 8:
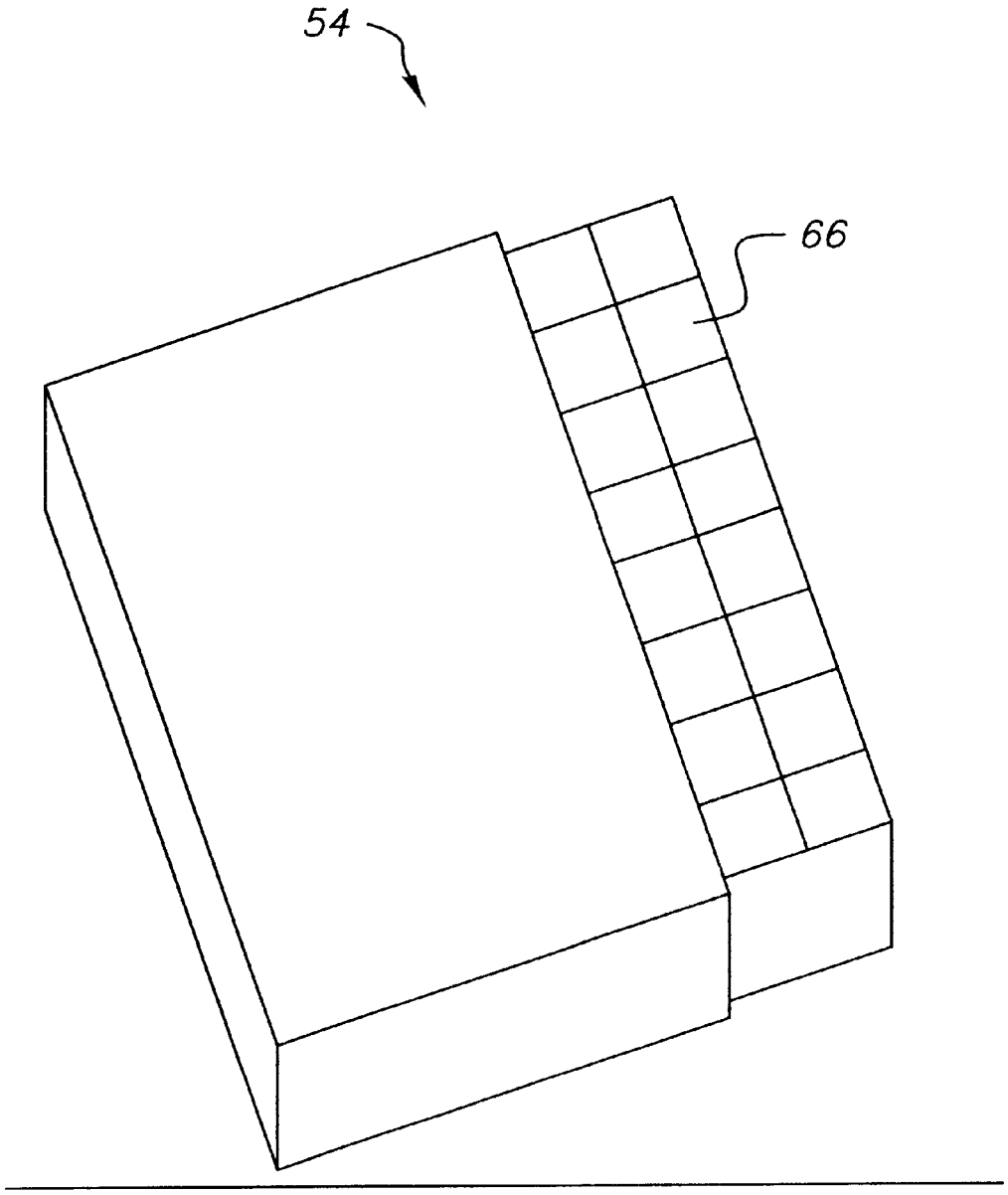
FIG. 8 is a product compartment tilted for better viewing by a retail customer.

Referring to FIG. 8, in another embodiment of the merchandising display 50 of the invention, products compartments 54 for receiving modular receptacle 66 is slightly tilted in the merchandising display 50. Slightly tilted product compartments 54 are preferably tilted upwardly towards the top wall of the frame 52 for ease of viewing and removing product 51 from the modular receptacle 66. Product compartments 54 are preferably tilted in frame 52 by angling the base of the frame 52.

Referring to FIG. 1, merchandising display 50 may alternatively include a promotional header 90. Promotional header 90 may be conveniently removably attached to a portion of frame 52 that is most visible to the consumer. Promotional header 90, generally made of paperboard, may be attached by tabs (not shown) on promotional header 90 that engages corresponding slots (not shown) in the frame 52.

Figure 9:
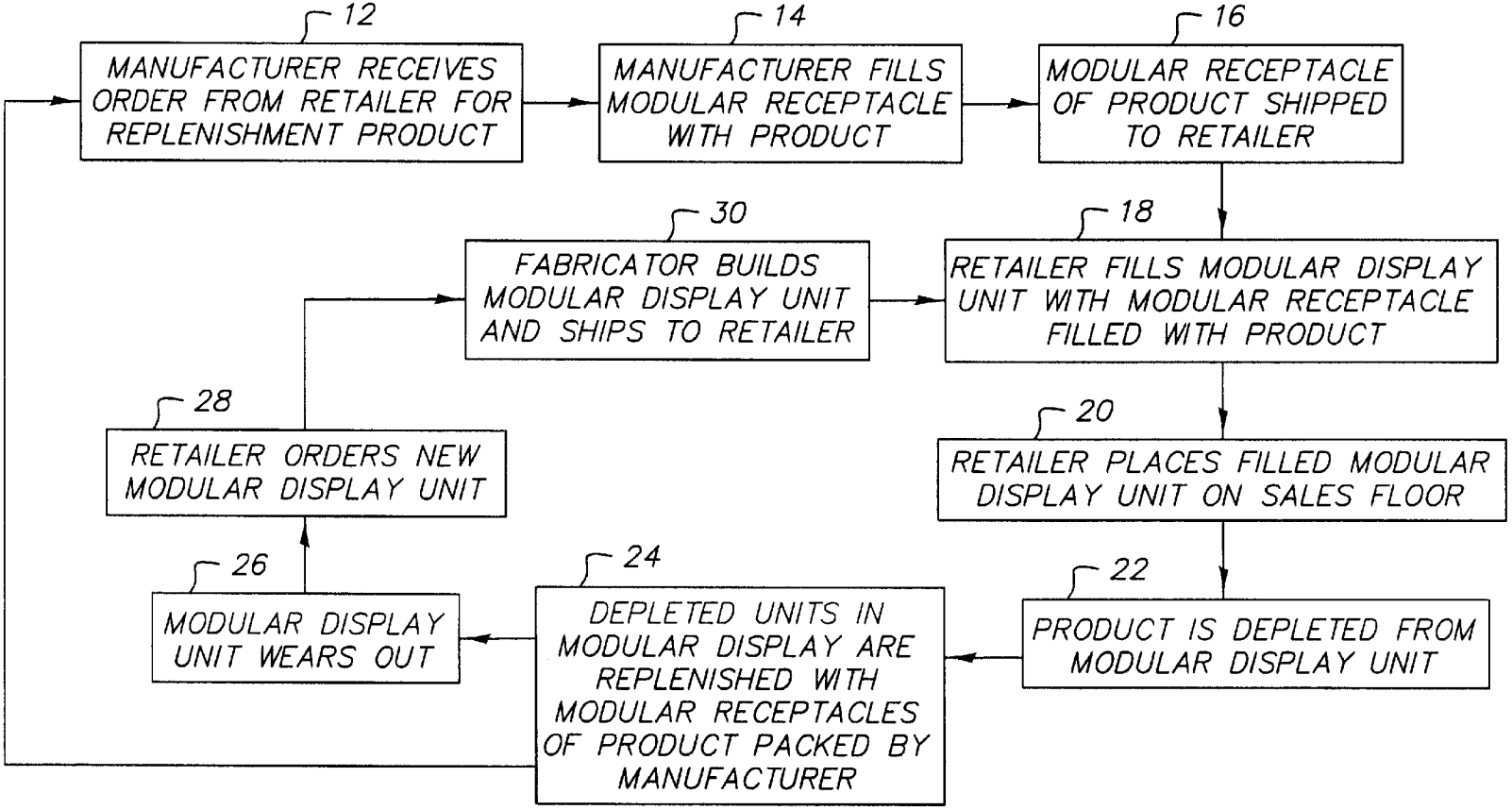
FIG. 9 is a flow diagram of the method of the invention.

Referring now to FIG. 9, the process of replenishing product 51 for retail in a merchandising display having at least one modular receptacle 66 is illustrated. According to FIG. 9, from the product manufacturer, the product 51, such as photographic film product or cameras, is packaged in the modular receptacle 66 for shipment to a retailer (Steps 12–16). Of course the product manufacturer would prepare the product against damage during shipment by either sealing the open portion of the modular receptacle 66 with shrink wrap or covering the opened portion with an appropriate covering before arranging the product in the receptacle for shipment to a designated retailer. Skilled artisans will appreciate that the aforementioned process can be achieved manually or with the use of automatic equipment.

During the normal course of business, the retailer would either have or would order (Step 28) a merchandising display 50 from a fabricator. These fabricators generally assemble the merchandising display 50 (Step 30) to meet the needs and specification of the product manufacturer. It is important to this novel and unobvious method that the merchandising display 50 be assembled from durable materials that can withstand long-term use and potentially abnormal handling. We have found that the most durable materials are ones selected from among corrugated plastic, thin molded plastic, or a coated paperboard corrugated material. Most preferred among these materials for our application is corrugated plastic.

As appropriate, the retailer would order at least one modular receptacle 66 containing the requested product therein. Product turnover and inventory are typical factors that may determine when such orders are actually placed.

Referring again to FIG. 9, in Step 18, once the modular receptacle 66 is received by the retailer, the retailer then removes any outer wrap that may exist to protect the product 51 during shipment and then places the modular receptacle 66 into the product compartment 54 of the merchandising display 50. With the product 51 stocked in the modular receptacle 66 and placed into the product compartment 54 of the merchandising display 50, they are now available for sale to a retail customer who can directly remove the product 51 from the merchandising display (Step 20). During the normal course of business, product 51 is depleted primarily by sales to retail customers (Step 22). According to Step 24, as product from an individual modular receptacle 66 is sold out or depleted, the empty modular receptacle 66 is removed and the merchandising display 50 is replenished with another modular receptacle 66 filled with product 51. It is expected that the merchandising display unit 50 will eventually wear out or break (Step 26). In those instances, the retailer would then place an order for a new merchandising display 50 (Steps 28).

The invention has been described with reference to a preferred embodiment. However, it will be appreciated that variations and modifications can be effected by a person of ordinary skill in the art without departing from the scope of the invention.

PARTS LIST

12 step: manufacturer receives order from retailer
14 step: manufacturer fills modular receptacles with product
16 step: modular receptacles of product shipped to retailer
18 step: retailer fills display unit with modular receptacles filled with product
20 step: retailer places filled merchandising display unit on sales floor
22 step: product is depleted from merchandising display unit
24 step: replenish with modular receptacles of product packed by manufacturer
26 step merchandising display unit wears out
28 step: retailer orders merchandising display
30 step: fabricator builds merchandising display unit
50 replenishable merchandising display unit
51 product
52 rigid frame
54 product compartment
56 top wall of product compartment 54
58 bottom wall of product compartment 54
60 side wall of product compartment 54
62 rear wall of product compartment 54
64 opening in product compartment 54
66 modular receptacle (product container)
68 side wall of modular receptacle 66
70 vertical stabilizer member of product compartment 54
72 horizontal member of product compartment 54
74 open face
80 open face container
82 shrink wrap material
84 roller member
90 promotional header

What is claimed is:

1. A replenishable merchandising display, comprising:

an upright standing, substantially rigid frame comprising a plurality of product compartments, each one of said plurality of product compartments having a top wall and an opposed bottom wall defining a base, and opposed side walls each being adjoined to a rear wall, and said opposed side walls exposing an opening to receive and access an at least one generally polygonal-shaped, modular receptacle, and wherein at least one of said plurality of product compartments has a vertical stabilizer member associated with said base for separating adjacent product compartments and for structurally supporting said plurality of product compartments, said vertical stabilizer member being substantially rectangular-shaped and rotatably associated with said base in said substantially rigid frame for accommodating said at least one generally polygonal-shaped, modular receptacle of a predetermined dimension; and, said at least one generally polygonal-shaped modular receptacle being removably stored in one of said plurality of product compartments, said generally polygonal-shaped modular receptacle accommodating a predetermined quantity of sales unit of a product.

2. The merchandising display recited in claim 1 wherein the substantially rigid frame comprises materials selected from the group consisting of: (a) thermoformable polymeric materials; (b) thermoset polymeric materials; (c) metallic materials; and, (d) corrugated plastic materials.

3. The merchandising display recited in claim 2 wherein the substantially rigid frame comprises a corrugated plastic material.

4. The merchandising display recited in claim 3 wherein said corrugated plastic material is corrugated polyethylene.

5. The merchandising display recited in claim 2 wherein said merchandising display further includes a plurality of roller members attached for rotation to an exterior portion of said frame for mobilizing said merchandising display.

6. The merchandising display recited in claim 2 wherein said base of said product compartment for supporting said product is slightly tilted upwardly towards said top wall of said frame for ease of viewing and removing said product from said at least one generally polygonal-shaped modular receptacle.

7. The merchandising display recited in claim 2 wherein a promotional header is removably attached to said frame.

8. The merchandising display recited in claim 6 wherein said promotional header is arranged along a top portion of said frame.

* * * * *